US011760525B2

(12) United States Patent
Ambartsoumian

(10) Patent No.: US 11,760,525 B2
(45) Date of Patent: Sep. 19, 2023

(54) METHOD AND KIT FOR LABELLING OBJECTS

(71) Applicant: Gourgen Ambartsoumian, Laval (CA)

(72) Inventor: Gourgen Ambartsoumian, Laval (CA)

( * ) Notice: Subject to any disclaimer, the term of this patent is extended or adjusted under 35 U.S.C. 154(b) by 484 days.

(21) Appl. No.: 16/649,676

(22) PCT Filed: Sep. 25, 2018

(86) PCT No.: PCT/CA2018/051204
§ 371 (c)(1),
(2) Date: Mar. 23, 2020

(87) PCT Pub. No.: WO2019/056130
PCT Pub. Date: Mar. 28, 2019

(65) Prior Publication Data

US 2021/0387763 A1 Dec. 16, 2021

Related U.S. Application Data

(60) Provisional application No. 62/725,664, filed on Aug. 31, 2018, provisional application No. 62/562,813, filed on Sep. 25, 2017.

(51) Int. Cl.
*B65C 9/26* (2006.01)
*B65C 1/02* (2006.01)
(Continued)

(52) U.S. Cl.
CPC ..... *B65C 9/262* (2013.01); *B65C 1/02* (2013.01); *G09F 3/02* (2013.01); *G09F 3/10* (2013.01);
(Continued)

(58) Field of Classification Search
CPC .. B65C 1/02; B65C 9/26; B65C 9/262; B44C 1/1733; G09F 3/02; G09F 3/0297;
(Continued)

(56) References Cited

U.S. PATENT DOCUMENTS 4,932,684 A * 6/1990 Vermeulen ..... G09F 3/10 156/247
5,421,950 A 6/1995 Parrish
(Continued)

FOREIGN PATENT DOCUMENTS

| | | |
|---|---|---|
| CN | 205854716 U | 1/2017 |
| DE | 20218710 U1 | 3/2003 |
| JP | H08268419 A | 10/1996 |

OTHER PUBLICATIONS

Machine translation of JP H08268419 via EPO (Year: 1996).*
(Continued)

*Primary Examiner* — Laura C Powers
*Assistant Examiner* — Rebecca L Grusby
(74) *Attorney, Agent, or Firm* — Norton Rose Fulbright Canada LLP

(57) ABSTRACT

A kit for labelling an object with a target label comprises an instrument having an end(s) for manipulating labels. Transfer label(s) adhered to the end of the instrument, the transfer label having a facestock having adhesive on at least one of its surfaces, an adhesion force A between a first surface of the facestock of the transfer label and the instrument being greater than an adhesion force B between a second surface of the transfer label and a target label. The instrument and transfer label are used to manually transfer the target label from a target label liner to an object by releasable adherence of the target label to the second surface of the transfer label. A method for labelling an object is also provided.

19 Claims, 5 Drawing Sheets

(51) Int. Cl.
*G09F 3/02* (2006.01)
*G09F 3/10* (2006.01)

(52) U.S. Cl.
CPC ..... *G09F 2003/0222* (2013.01); *G09F 2003/0226* (2013.01); *G09F 2003/0245* (2013.01); *G09F 2003/0273* (2013.01)

(58) Field of Classification Search
CPC ..... G09F 3/10; G09F 2003/0216; G09F 2003/0222; G09F 2003/0226; G09F 2003/0245; G09F 2003/0272; G09F 2003/0273
See application file for complete search history.

(56) References Cited

U.S. PATENT DOCUMENTS 5,591,290 A * 1/1997 Walter ..... C09J 7/38 156/247
5,846,624 A * 12/1998 Denklau ..... G09F 3/10 283/81
2004/0155052 A1* 8/2004 Fore ..... B65C 11/002 221/235
2005/0084641 A1* 4/2005 Downs ..... C09J 7/401 156/541
2008/0047185 A1* 2/2008 Schreiner ..... G09F 3/10 40/630
2012/0086958 A1* 4/2012 Srnka ..... G06F 3/1271 358/1.6
2014/0318700 A1* 10/2014 Henderson ..... B65C 9/1869 156/767
2014/0342112 A1* 11/2014 Gruber ..... B31D 1/021 428/347

OTHER PUBLICATIONS

Machine translation of CN 205854716 via EPO (Year: 2017).*
"Label Liners—The Red Carpet for Labels", https://web.archive.org/web/20160419061840/https://barcode-labels.com/getting-started/labels/liners/, Published Apr. 19, 2016; Retrieved from Wayback Machine (Year: 2016).*
"Eforlike 50 Pieces Double-Sided Dots Foam Tapes Adhesive Mounting Pads", https://www.amazon.com/Eforlike-Double-sided-Adhesive-Mounting-Dia-50mm/dp/B076FN8WF3 (Year: 2017).*

* cited by examiner

METHOD AND KIT FOR LABELLING OBJECTS

CROSS-REFERENCE TO RELATED APPLICATION

The present application claims the priority of U.S. Patent Application No. 62/562,813, filed on Sep. 25, 2017, and of U.S. Patent Application No. 62/725,664, filed on Aug. 31, 2018, both of which are incorporated herein by reference.

TECHNICAL FIELD

The present application relates to manual labelling (a.k.a., labeling) of objects with small labels, for instance in the field of biosciences and chemistry among others, such as when labelling vial caps and like small containers.

BACKGROUND OF THE ART

Labels are commonly used to identify objects of all sorts. While labelling has been automated, there remains labelling activity requiring manual operations. When labelling small objects, e.g., in a range of millimeters or a few centimeters at most, it may be quite time-consuming for a person to label the objects. For instance, manipulating a small label, and then applying the small label to a small object, may require time in addition to good dexterity. There are numerous examples of such time-consuming manual labelling operations, such as the labelling of the vial caps or other small containers or objects, the labelling of electronic chip-boards and the like. In another example, the action of labelling containers with gloves on in laboratories may be challenging because the labels can stick to gloves and may then be difficult to remove. There are a multitude of fields in which small areas must be identified with small labels.

SUMMARY

It is therefore an aim of the present disclosure to provide a method for labelling objects with a small label that addresses issues related to the prior art.

It is another aim of the present disclosure to provide a kit for labelling objects with a small label that addresses issues related to the prior art.

Therefore, in accordance with a first embodiment of the present disclosure, there is provided a kit for labelling an object with a target label comprising: an instrument having at least one end for manipulating labels; at least one transfer label adhered to the end of the instrument, the transfer label having a facestock having adhesive on at least one of its surfaces, an adhesion force A between a first surface of the facestock of the transfer label and the instrument being greater than an adhesion force B between a second surface of the transfer label and a target label, whereby the instrument and transfer label are used to manually transfer the target label from a target label liner to an object by releasable adherence of the target label to the second surface of the transfer label.

Further in accordance with the first embodiment, at least one transfer label liner supports for instance the at least one transfer label, the adhesion force A between the first surface of the facestock of the transfer label and the end of the instrument being greater than an adhesion force C between the second surface of the transfer label and the transfer label liner, whereby the instrument is used to manually transfer the transfer label from the at least one transfer label liner to its end by releasable adherence of the transfer label to the end of the instrument.

Still further in accordance with the first embodiment, both the first surface and the second surface of the transfer label have for instance adhesive thereon.

Still further in accordance with the first embodiment, two of the transfer label liner are for instance provided, one of the transfer label liner being on the first surface of the transfer label, and another of the transfer label liner being on the second surface of the transfer label.

Still further in accordance with the first embodiment, at least one of the target label is for instance adhered to a target label liner, the target label having a facestock adapted to have information inscribed/printed thereon, the adhesion force D between the second surface of the transfer label and the facestock of the target label being greater than an adhesion force E between the target label and the target liner, and further wherein an adhesion force F between the target label and a target surface of an object is adapted to be greater than said adhesion force D, whereby the instrument with the transfer label is used to manually transfer the target label from the target label liner to the target surface of the object by releasable adherence of the target label to the second surface of the transfer label at the end of the instrument.

Still further in accordance with the first embodiment, the target label has for instance a largest dimension between 0.05" and 0.5" inclusively.

Still further in accordance with the first embodiment, the target label has for instance a largest dimension between 0.2" and 1" inclusively.

Still further in accordance with the first embodiment, instrument adhesive is for instance received on said end of the instrument to provide said adhesion force A.

Still further in accordance with the first embodiment, the instrument adhesive is for instance defined by a dot of the instrument adhesive adhered to a dot liner, an adhesion force G between the dot and the instrument being greater than an adhesion force H between the dot and the dot liner.

Still further in accordance with the first embodiment, the target label comprises for instance an RFID, NFC tag, any electronic component and/or a wireless component.

Still further in accordance with the first embodiment, a cap is for instance releasably mounted to the end to cover the transfer label on the end, an adhesion force I between the second surface of the transfer label and the cap being less than the peel adhesive value A.

Still further in accordance with the first embodiment, the cap has for instance a silicone layer laid against the second surface of the transfer label.

Still further in accordance with the first embodiment, the at least one transfer label has for instance a tab projecting therefrom, the tab being sized to project from the end of the instrument when the transfer label is on the end of the instrument.

Still further in accordance with the first embodiment, the at least one transfer label liner has for instance tear-off perforations and/or at least one slit therein.

Still further in accordance with the first embodiment, the instrument and/or the labels are for instance sterilized in packaging.

Still further in accordance with the first embodiment, the instrument is for instance a rod and/or is pen-shaped.

Still further in accordance with the first embodiment, the instrument has for instance two of the end for manipulating labels.

Still further in accordance with the first embodiment, the instrument has for instance a S-shape.

Still further in accordance with the first embodiment, the instrument has for instance a receptacle, and adhesive in the receptacle, the receptacle open to the end for adhesive in the receptacle to be exposed at the end.

Still further in accordance with the first embodiment, the instrument has for instance an exchangeable tip at the end.

Still further in accordance with the first embodiment, the exchangeable tip has for instance a rotational configuration.

In accordance with a second embodiment of the present disclosure, there is provided a method for labelling an object comprising: applying an instrument having an adhesive at an end thereof against a facestock of a target label adhered to a target label liner, an adhesion force A between the adhesive and the facestock being greater than an adhesion force B between the target label and the target label liner; peeling the target label from the liner by distancing the instrument from the target label liner with the target label adhered to the adhesive at the end of the instrument; applying the end of the instrument with the target label thereon against a target surface of the object, an adhesion force C between the target label and the object being greater than said adhesion force A between the adhesive and the facestock; and distancing the instrument from the object with the target label adhering to the target surface of the object and detaching from the end of the instrument.

Further in accordance with the second embodiment, the method is for instance performed with the target label having a largest dimension between 0.05" and 0.5" inclusively.

Still further in accordance with the second embodiment, the method is for instance performed with the target label having a largest dimension between 0.2" and 1" inclusively.

Still further in accordance with the second embodiment, a transfer label is for instance adhered to the end of the instrument, said adhesive at the end of the instrument being that of the transfer label.

Still further in accordance with the second embodiment, adhering the transfer label to the end of the instrument includes for instance manually applying the end of the instrument against a facestock of the transfer label adhered to a transfer label liner with a transfer adhesive between, an adhesion force D between the facestock of the transfer label and the end of the instrument being greater than an adhesion force E between the transfer label and the transfer label liner; the transfer label manually peeled for instance from the liner by distancing the instrument from the liner with the transfer label adhered to the adhesive D at the end of the instrument.

Still further in accordance with the second embodiment, adhering the transfer label to the end of the instrument includes for instance applying the end of the instrument to a facestock with the transfer adhesive of the transfer label adhered to the transfer label liner.

Still further in accordance with the second embodiment, another transfer label liner is removed for instance from the transfer label to expose the transfer adhesive.

Still further in accordance with the second embodiment, adhering the transfer label to the end of the instrument includes for instance applying the transfer adhesive to the end of the instrument by: applying the end of the instrument against a dot of the transfer adhesive adhered to a dot liner, an adhesion force F between the dot and the instrument being greater than an adhesion force G between the dot and the dot liner; and removing the dot from the dot liner by distancing the instrument from the dot liner with the dot at the end of the instrument.

Still further in accordance with the second embodiment, the method is for instance performed with the target label comprises an RFID or NFC tag or any electronic or wireless component.

Still further in accordance with the second embodiment, a cap is for instance removed from the end of the instrument to expose the adhesive at the end of the instrument before applying the instrument against a facestock of any label.

Still further in accordance with the second embodiment, the end of the instrument is for instance with a cap to cover the adhesive at the end of the instrument.

Still further in accordance with the second embodiment, the method is for instance repeated for a plurality of the target label without replacing the adhesive at the end of the instrument.

In accordance with a third embodiment of the present disclosure, there is provided a kit for labelling objects comprising: an instrument having an end for manipulating labels; an adhesive A for being received on said end of the instrument; and a target label adhered to a liner, the target label having a facestock adapted to have information inscribed/printed thereon, an adhesion force A between the adhesive A and the facestock of the target label is greater than an adhesion force B between the target label and the liner, and further wherein an adhesion force C between the target label and a target surface of an object is adapted to be greater than said adhesion force A between the adhesive A and the facestock; whereby the instrument is used to manually transfer the target label from the liner to the target surface of the object by releasable adherence of the target label to the adhesive A at the end of the instrument.

Further in accordance with the third embodiment, the target label has for instance a largest dimension between 0.05" and 0.5" inclusively.

Still further in accordance with the third embodiment, the target label has for instance a largest dimension between 0.2" and 1" inclusively.

Still further in accordance with the third embodiment, a transfer label is for instance adhered to a liner, the adhesive A being that of the transfer label.

Still further in accordance with the third embodiment, an adhesive D is for instance received on said end of the instrument, an adhesion force D between the adhesive D and the facestock of the transfer label being greater than an adhesion force E between the transfer label and the liner, whereby the instrument is used to manually transfer the transfer label from the liner onto its end by adherence of the transfer label to the adhesive D at the end of the instrument.

Still further in accordance with the third embodiment, the adhesive D is for instance defined by a dot F of the adhesive D adhered to a liner G, an adhesion force F between the dot F and the instrument being greater than an adhesion force G between the dot F the liner G.

Still further in accordance with the third embodiment, the target label comprises for instance an RFID or NFC tag or any electronic or wireless component.

Still further in accordance with the third embodiment, the instrument and/or the labels are for instance sterilized in packaging.

Still further in accordance with the third embodiment, the instrument is for instance a rod and/or is pen-shaped.

Still further in accordance with the third embodiment, the instrument has for instance two of the end for manipulating labels.

Still further in accordance with the third embodiment, the instrument has for instance a S-shape.

Still further in accordance with the third embodiment, the instrument has for instance a receptacle, and adhesive in the receptacle, the receptacle open to the end for adhesive in the receptacle to be exposed at the end.

Still further in accordance with the third embodiment, the instrument has for instance an exchangeable tip at the end.

Still further in accordance with the third embodiment, the exchangeable tip has for instance a rotational configuration.

For the purpose of the present disclosure, label is defined as a material of any origin including but not limited to paper, plastic, plastic film, thermoplastic film, polymeric structure, metal, foil, crystal, silicone, stone, fabric, tissue, cloth, wood, composite material, or any combination thereof coated with adhesive. Label material thicknesses are commonly between 0.4 mils and 30 mils but thicker materials up to 100 mils such as washers can be used for a wide range of applications.

DESCRIPTION OF THE DRAWINGS

FIGS. 1 to 10 are a sequence of steps of a method for labelling objects with labels, in which:

FIG. 1 is a schematic view of adhesive dots on a backing strip;

FIG. 2 is a schematic view of a transfer instrument picking up an adhesive dot;

FIG. 3 is an end view of the transfer instrument with the adhesive dot on its end surface;

FIG. 4 is a plan view of transfer labels on a backing sheet;

FIG. 5 is a schematic view of the transfer instrument picking up a transfer labels;

FIG. 6 is an end view of the transfer instrument with the transfer label on its end surface;

FIG. 7 is a schematic view of the transfer instrument picking up a target label;

FIG. 8 is an end view of the transfer instrument with the target label on its end surface;

FIG. 9 is a perspective view of the transfer instrument applying the target label to a target surface of an object;

FIG. 10 is a perspective view showing the object with the target label and the transfer instrument with the transfer label remaining on its end surface;

DETAILED DESCRIPTION

A method for labelling objects with labels in accordance with the present disclosure is shown in the sequence of FIGS. 1-10. The method of FIGS. 1-10 is conveniently practical when labelling objects with small labels (in a range of millimeters or a few centimeters at most), in particular when applying such small labels on small surfaces or small objects. A non-exhaustive list of fields and objects to which the method of the present disclosure may be beneficial is provided below.

Figure 1:
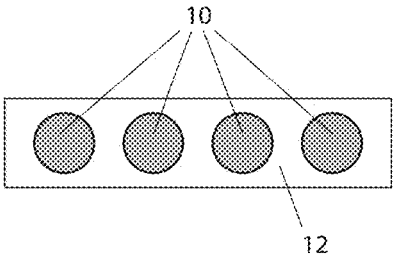

Referring to FIG. 1, a plurality of adhesive dots 10 (a.k.a., instrument adhesive) are illustrated, as being on a backing strip 12. The adhesive dots 10 may be on any appropriate backing format (a.k.a., liner), such as a sheet, a single-dot piece, etc. In an embodiment, the backing strip 12 is part of a dispenser device.

Figure 2:
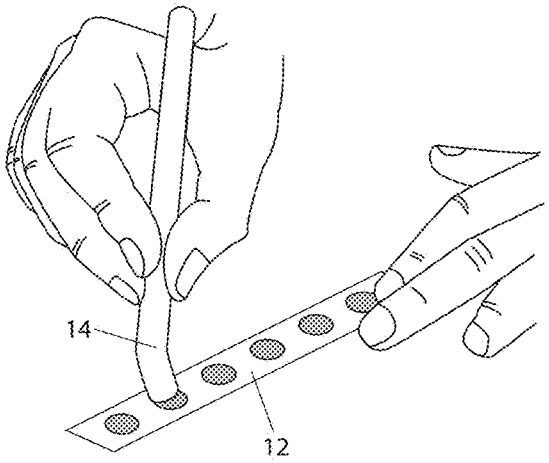
Figure 3:
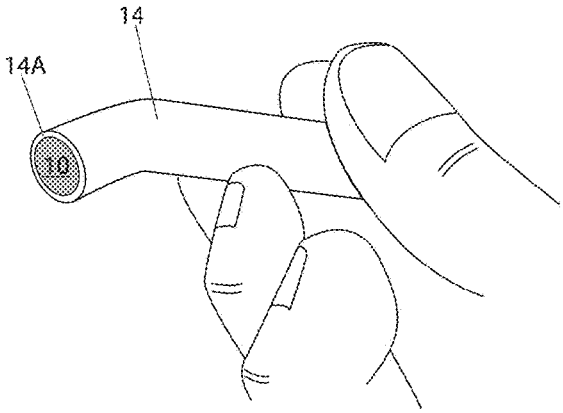

Referring to FIGS. 2 and 3, a transfer instrument 14 is shown. The transfer instrument 14 may have any appropriate body shape so as to be manually handled by a user. The transfer instrument 14 is shown as being an elongated rod of circular cross-section, with one or more flat contact end surface 14A, and a bend in the rod adjacent to the contact end surface 14A. The transfer instrument 14 is thus shaped as a stylus to be handled as a pen, but other geometries are contemplated (not just elongated), such as with a wider body, such as a paddle, with any appropriate cross-sections, including various polygonal sections—square, rectangle, triangle, hexagonal, octagonal, etc. or other symmetric or asymmetric or atypical sections. In an embodiment, the instrument 14 may have a combination of shapes such as a cylindrical shape body and a square or polygon-shape tip or any other combination of shapes and configurations. The transfer instrument 14 can be in any color and might be blank or printed with any graphic, image, logo, barcode, serial number or data. The transfer instrument 14 may comprise a punch, a hole, embossed area, drilled hole, a carve, groove, stamp (a design) or a relief or an attachment such as a metal ring to attach a hand-strip. The transfer instrument 14 may incorporate a battery operated light or a digital device such as a clock/timer, or a wireless communication tag or device such as RFID or NFC tag. The contact end surface 14A is shown as being a flat or quasi-flat surface. However, other types of surfaces are possible, though flat is preferred for the adhesion of the adhesive dot 10 to it, in the manner shown in FIG. 3. Indeed, as shown in FIG. 2, the transfer instrument 14 is used to pick up an adhesive dot 10. The transfer instrument 14 is hovered over one of the dots 10, and pressed upon it for the dot 10 to adhere to the contact end surface 14A. The adhesion between the dot 10 and the contact end surface 14A is greater than between the dot 10 and the backing 12, as the backing 12 is designed with a view to allowing a release of the dot 10. The diameter of the contact end surface 14A (e.g., 0.05"-0.5", 0.2"-1") may be equal or greater than that of the adhesive dot 10, so as not to have the dot 10 exceed the perimeter of the contact end surface 14A. In another embodiment, the adhesive is in a liquid or gel form in any appropriate recipient, and the end of the transfer instrument 14, including the end surface 14A is dipped into the adhesive to cover at least the end surface 14A. In another embodiment, the instrument 14 is a glue stick, with a glue cylinder being displaceable out of the receptacle of the glue stick. In another embodiment, the displaceable cylinder comprises a chamber with a liquid or gel-like or wax-like glue that can exit from the tip of the instrument 14. The tip may comprise a mesh-like surface or a surface with holes through which the glue can pass to be exposed at the end surface 14A of the tip of the instrument 14. The glue can be displaced through the cylinder through a lip-stick or glue-stick like mechanism manually actuated or through an electronic module pressing the glue out of the instrument 14.

The concepts of adhesion and adhesion force are used herein to describe the bond between the adhesives and the surfaces they contact. Other expressions for adhesion may include "tack", "tackiness", "stickiness", "bond surface energy", "bonding forces", "adherence", "peel adhesion value", etc. For simplicity, the expression "adhesion" is mostly used throughout. The adhesion parameters may for instance be measured by loop tack, and referred to as "adhesion force" according to ASTM (American Society for Testing and Materials).

Figure 4:
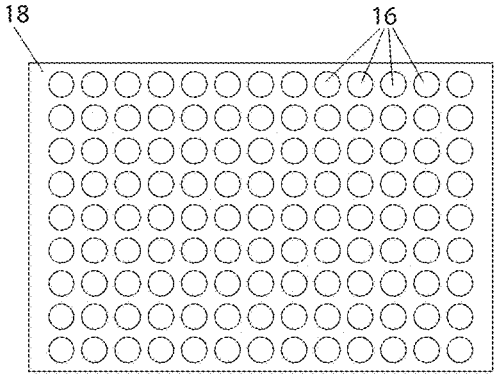
Figure 5:
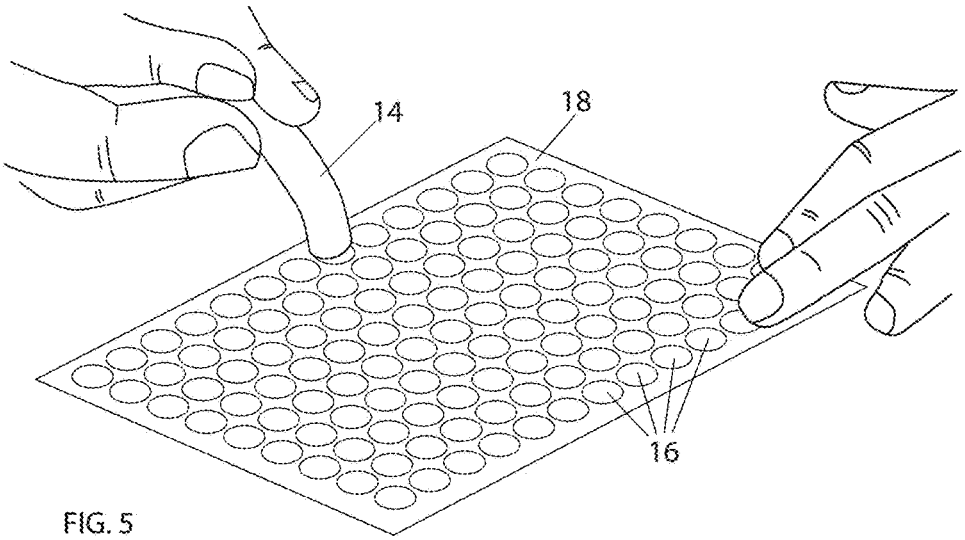
Figure 6:
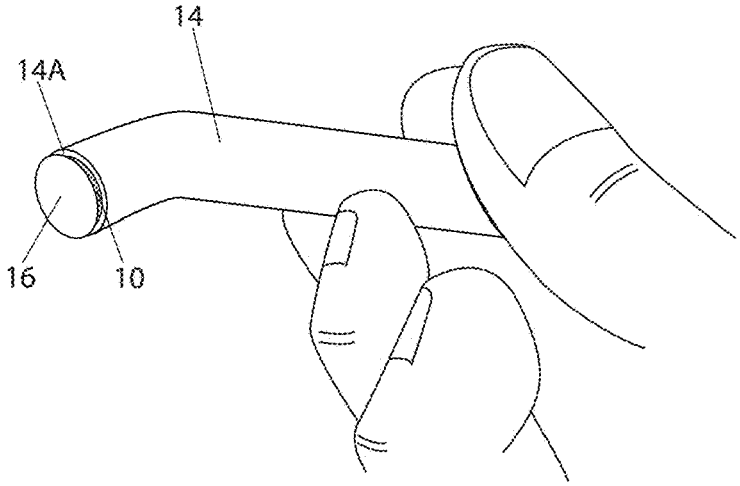

Referring to FIGS. 4 to 6, the transfer instrument 14 with adhesive 10 at the end surface 14A is then used to collect a transfer label 16. In FIG. 4, a plurality of transfer labels 16 are illustrated, as being on a backing sheet 18. The transfer labels 16 may be on any appropriate backing format (a.k.a., liner), such as a sheet, a single-label piece, etc. The transfer labels 16 have a single face with adhesive, namely the one applied to the backing 18. The transfer labels 16 typically have a dimension similar or slightly smaller to that of the end surface 14A.

In similar fashion to the picking up of the dot 10, as shown in FIG. 2, the transfer instrument 14 with adhesive 10 is used to pick up the transfer label 16 in FIG. 5. The transfer instrument 14 is hovered over one of the labels 16, and pressed upon it for the adhesive-less surface of the transfer label 16 to adhere to the contact end surface 14A by way of the adhesive 10. The adhesion between the dot 10 and the transfer label 16 is greater than between the transfer label 16 and the backing 18 as the backing 18 is designed with a view to allowing an easy release of the label 16. After this operation, the transfer label 16 is at the end of the transfer instrument, as in FIG. 6, with its tacky surface exposed and leading the end of the transfer instrument 14.

Figure 7:
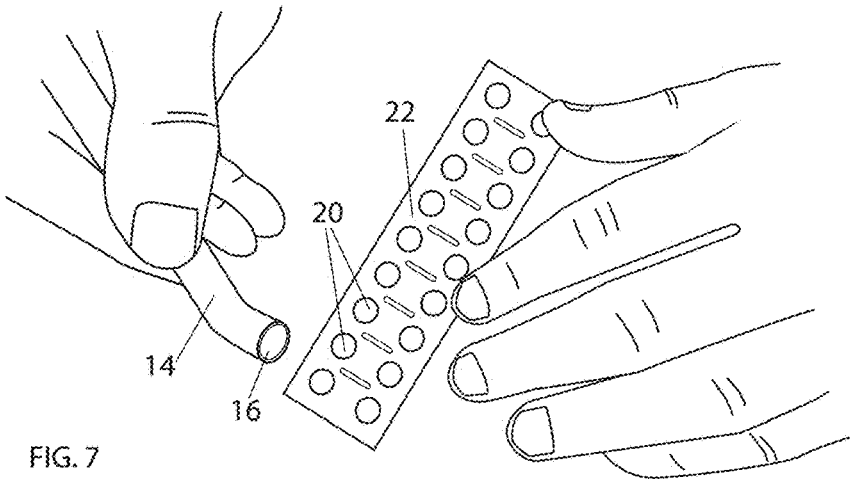
Figure 8:
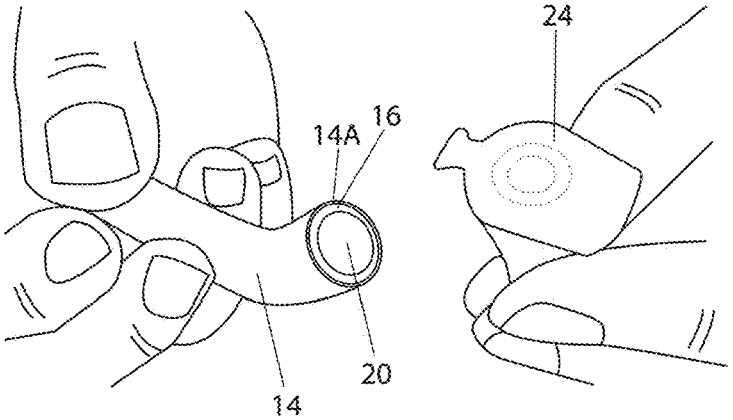
Figure 9:
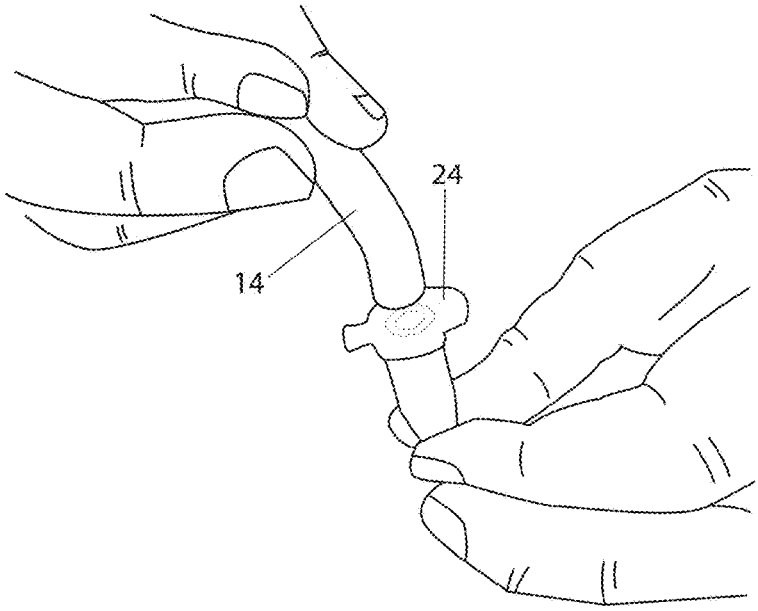

The same operation is repeated, as in FIGS. 7 and 8, but with a target label 20, i.e., the one that will be identifying an object. In FIG. 7, a plurality of target labels 20 are illustrated, as being on a backing strip 22. The target labels 20 may have information inscribed or printed thereon, for identification of an object 24. The target labels 20 may be on any appropriate backing format (a.k.a., liner), such as a sheet, a single-label piece, a roll, etc. The target labels 20 have a single face with adhesive, namely the one applied to the backing 22, and with information written on the main face, i.e., the exposed one without the adhesive. The target labels 20 may include electronic components, such as RFID or NFC chips. In an embodiment, the target label 20 is an RFID or NFC tag comprising adhesive. The target labels 20 typically have a dimension equal to or smaller than that of the transfer label 16.

In similar fashion to the picking up of the dot 10 and of the transfer label 16, as shown in FIG. 2 and FIG. 5, respectively, the transfer instrument 14 with adhesive 10 is used to pick up the target label 20. The transfer instrument 14 is hovered over one of the labels 20, and pressed upon it for the adhesive-less surface of the target label 20 to adhere to the contact end surface 14A by way of the tacky surface of the transfer label 16. The adhesion between the target label 20 and the transfer label 16 is greater than between the target label 20 and the backing 22 as the backing 22 is designed with a view to allowing an easy release of the label 20 therefrom. After this operation, the target label 20 is at the end of the transfer instrument 14, as in FIG. 8, with its tacky surface exposed and leading the end of the transfer instrument 14.

Figure 10:
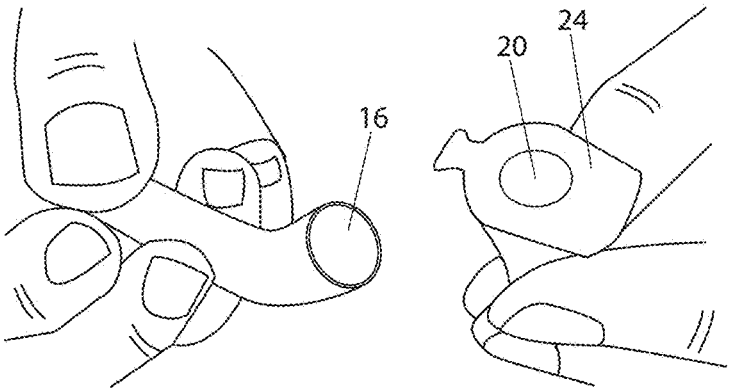

The target label 20 may then be applied to the object 24, herein shown as a vial just by way of example. The exposed tacky surface of the target label 20 is positioned against the target surface of the object 24, and pressure is applied for the target label 20 to adhere to the target surface of the object 24. As shown in FIG. 10, the transfer label 16 remains on the transfer instrument 14, such that the sequence of FIGS. 7, 8 and 9 may be repeated to place another target label 20 on an object 24.

In an embodiment, the method of manual application may be regarded as having three steps: 1) peeling and lifting of the small target label 20 from the support liner 22; 2) Placing it on a small or confined area or on an object 24; and 3) releasing it from the transfer instrument 14.

The method is based on the fact that the adhesion force of the target label 20 to the target surface of the object 24 is stronger compared to the adhesion force of the transfer label 16 to the surface of the target label 20. The difference in the adhesion force causes a detachment of the target label 20 from the adhesive of the transfer label 16, and results in its transfer to the object 24.

Also, at the same time, the adhesion force of the adhesive 10 to the non-adhesive surface (facestock) of the transfer label 16 is stronger than the adhesion force of the adhesive of the transfer label 16 to the target label 20 which allows the transfer label 16 to remain attached to the adhesive 10 during or after the transfer of the target label 20 to the object 24. After a number of transfers, the transfer label 16 or the adhesive dot 10 or both can be changed, for the same instrument 14.

As mentioned above, in order to achieve the relative adhesion properties described above, the adhesion parameters can be measured by loop tack, and peel adhesion according to ASTM (American Society for Testing and Materials), to ensure the above-described bonding forces are applied for the method to be adequately performed. The values will depend on the surface of the object 24 on which the target labels 20 are being applied and the facestock material of the labels 16 and 20. The importance is the difference between adhesion forces of the adhesive of the target label 20 being applied to the object 24 and the adhesive of the transfer label 16 applied to the face of the target label 20, and this may be coined as relative adhesion values as well. Therefore, the adhesion value of the target label 20 should be stronger than the adhesion value of the transfer label 16 to the respective surfaces.

According to other embodiments, the instrument 14 is a disposable rod with a preattached adhesive label on the end surface 14A, or even on opposed ends thereof. The instrument 14 may be a disposable rod when the transfer adhesive is coated directly on the end surface 14A and other end surface (no need for transfer label 16).

The method may be used in the following fields, activities, objects: Labelling of small vials, biomedical containers, small objects and devices, hard to label locations such as surfaces that located on the bottom of a well-like container, or have an indentation, or inside crevices, electronic boards and components, electronic devices, clean room applications, electrical equipment and wiring, automotive industries, avionics, instrumentation, gages, labelling procedure requiring a magnifying glass or a microscope, jewelry, optical and in any other type of industrial, research or field where an identification with small labels are required. The rod or the instrument can be customized to have a different shape or configuration to meet the requirements of the labelling application, as exemplified herein after with reference to FIG. 16. The rod can be made of a wide variety of any types of materials including but not limited to materials that have a flexibility to twist and turn the rode under any angle or extend it to a desired length. In an embodiment, the instrument 14 consists of a material including one or more of the following: a plastic, glass, metal or wood. The glue, the target label and/or transfer label can have any shape or configuration, such as circle, rectangle, square, triangle, polygon and any other symmetric or asymmetric or atypical shape. The target label 20 and the transfer label 16 can be printed or blank. The target label 20 and/or transfer label 16 can be of any shape or can be in any format, e.g. roll, sheet, fanfold, stripe, booklet, etc.

Figure 11:
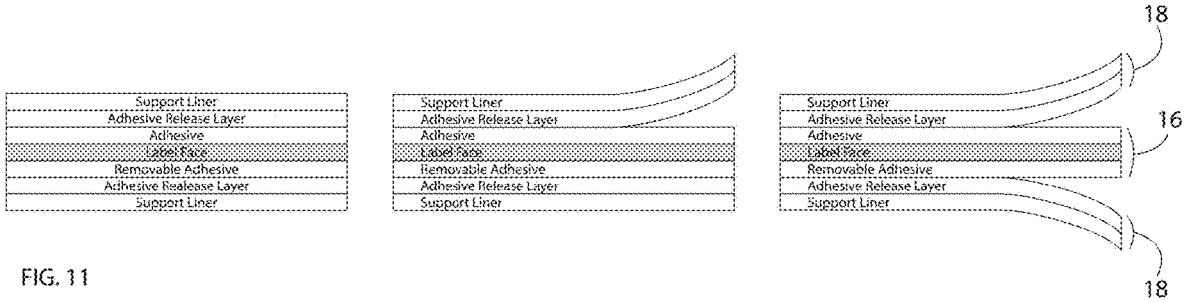
FIG. 11 is a schematic view of another embodiment of transfer label in accordance with the present disclosure, between support liners.
Figure 12:
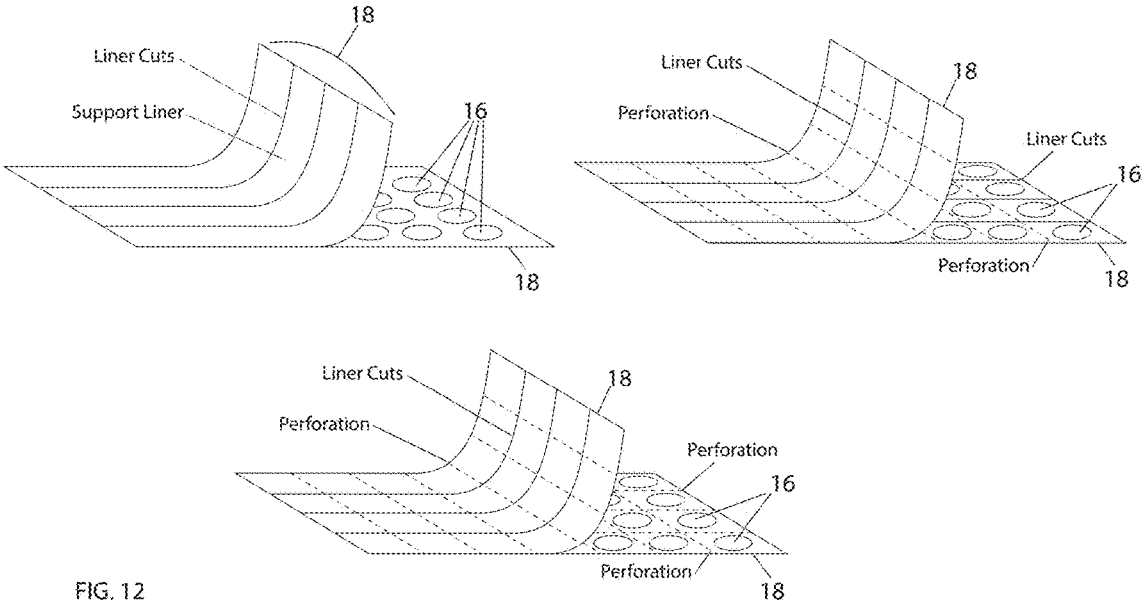
FIG. 12 is a schematic view of various liner cuts and perforation patterns on a sheet having multiple of the transfer label of FIG. 11.
Figure 13:
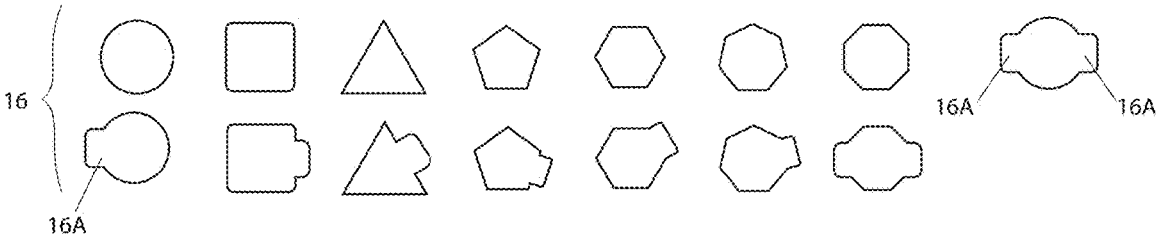
FIG. 13 are top views of exemplary shapes of the transfer label of FIG. 11.
Figure 14:
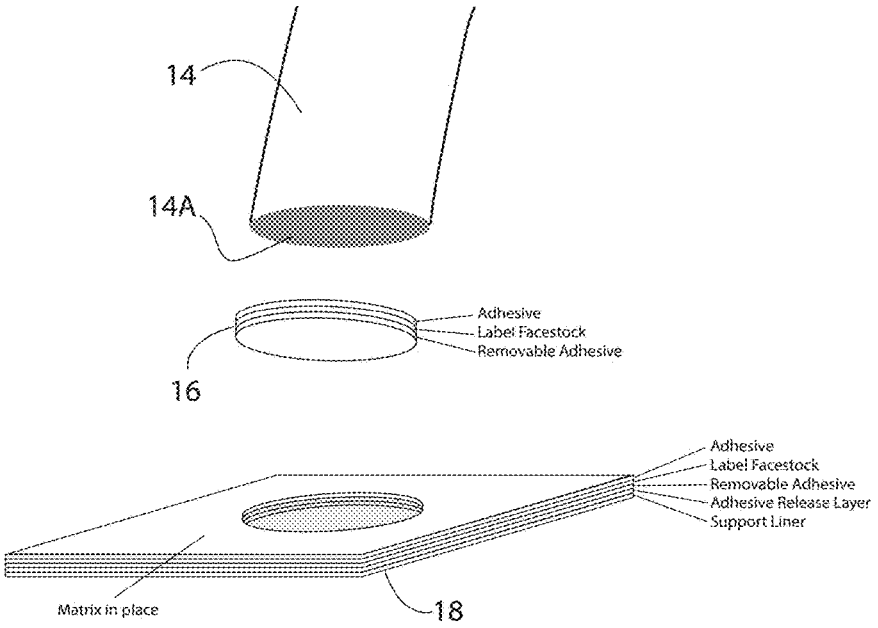
FIG. 14 is a perspective schematic view showing the transfer instrument with the transfer label of FIG. 11.
Figure 15:
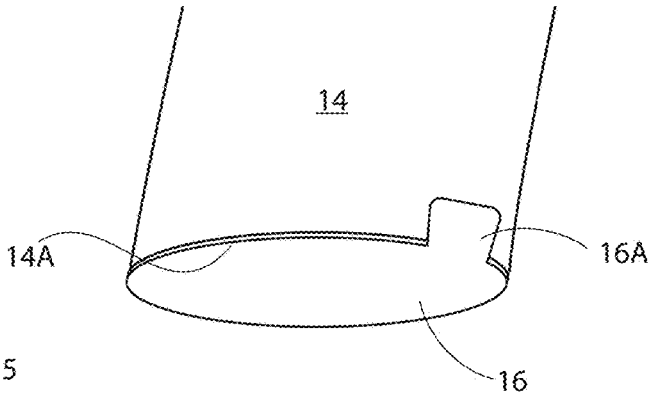
FIG. 15 is a perspective view of the transfer instrument with the transfer label of FIG. 11, with a tab.

Referring to FIGS. 11 to 15, an alternative embodiment is shown, in which the transfer label 16 has both of its faces coated with an adhesive, in such a way that the adhesive dot 10 is not required to stick the target label 20 on the object 24. FIG. 11 shows one possible construction of the transfer label 16 on the backing 18, identified in the FIG. 11 as support liners. As both sides of the label face of the transfer label 16 have an adhesive, the transfer label 16 (including its label face and adhesive layers) may be sandwiched between a pair of backing sheets 18, i.e., the support liners in FIG. 11. In that manner, the transfer labels 16 are protected from inadvertent contact with their environment before they are adhered to the transfer instrument 14. To assist in the removal of one of the support liners from the transfer label 16, or in the detachment of a transfer label 16 from the other support liner by use of the transfer instrument 14, an adhesive release layer may be provided on the support liners 18 as shown in FIG. 11. The adhesive release layer may be an integral coating on the support liner 18 (e.g., a wax or a silicone, among other examples). Alternatively, the support liner 18 may have non-stick properties that may not require the presence of any additional adhesive release layer. As shown in FIG. 14, the series of layers of FIG. 11 may define a matrix surrounding the transfer label 16 by appropriate liner cuts. It is contemplated to have a series of layers without such matrix as well.

As the transfer labels 16 may be used one at a time in the method described above by manipulation of the transfer instrument 14, the support liner(s) may be provided with liner cuts or perforations as shown in FIG. 12, to expose one transfer label 16 at a time, to define elongated strips of transfer labels 16, or to allow squares of one transfer label 16 and support liner(s)/backing sheet 18 to be separated from a remainder of the sheets of FIG. 12. The combination of slits (a.k.a., cuts) and perforations allows stripping away the support liner 18 through the cut lines, and separating desired sections through the perforations while maintaining the structural integrity of the sheet. The cuts and the perforations of different layers including the support liners and the transfer label material itself can be in any direction or orientation. Furthermore, the cuts and perforations may have some angles, curved shaped configurations and twists or combinations thereof to facilitate the manipulations. These are options among others. Moreover, while FIGS. 11 and 12 show a round transfer label 16, other shapes are considered as well. FIG. 13 shows a few shapes among others, for the transfer label 16. Some of the shapes include a tab 16A. The transfer label 16 with a tab 16A may be sized in such a way that the tab 16A projects beyond the contact end surface 14A of the transfer instrument 14 in the manner shown in FIG. 15. The tab 16A may consequently be used for a user to manually pull the transfer label 16 off of the instrument 14, to change it when one or more target labels 20 have been applied to an object 24 with the transfer label 16 and the transfer label 16 has lost some tackiness. The tab 16A may also increase the contact surface of the transfer label 16 on the end surface 14A of the instrument 14, resulting in a better adherence in view of repeated uses of a same transfer label 16 in numerous target label applications.

The adhesion between the contact end surface 14A of the transfer instrument 14 and the transfer label 16 may be greater than between the transfer label 16 and the backing 18 (support liner) as the backing 18 is designed with a view to allowing an easy release of the label 16. It is therefore contemplated to have adhesives on the transfer label 16 with different adherence properties, such as tackiness, loop-tack or peel adhesion, to ensure that the transfer label 16 sticks on the contact end surface 14A of the transfer instrument 14 while being picked up, and for the target label 20 to transfer onto the object 24 from the transfer label 16, with the transfer label 16 remaining on the instrument 14. According to an embodiment, the adhesives on opposite sides of the transfer label 16 may be the same although the loop-tack and peel-adhesion values may be different between the target label 20 and object surface compared to the transfer label 16 and the facestock of the target label 20. However, as it is desired that the transfer label 16 remain on the instrument 14 while the target label 20 attaches and detaches from it, the contact end surface 14A may have given adhesion properties to cause a greater adherence with the transfer label 16 than that of the transfer label 16 on the support liner (backing 18), or than that of the transfer label 16 with the target label 20. The contact end surface 14A may be chosen for its adhesion properties, whether or not it is used with a transfer label 16 having distinct adhesives.

The transfer label 16 can be provided as a separate unit, as a refill to be used with the instrument 14, for instance in the form of sheets as in FIG. 12. The transfer label 16 as well as any components described in the present disclosure can be provided in a sterile condition, individually or as combined with other components such as the instrument 14, caps 30 for the instrument 14, target labels 20, and/or the objects that will be labeled. All or some parts of a kit may be sterilized, or they can be provided as non-sterile that can be sterilized by the user.

Figure 16:
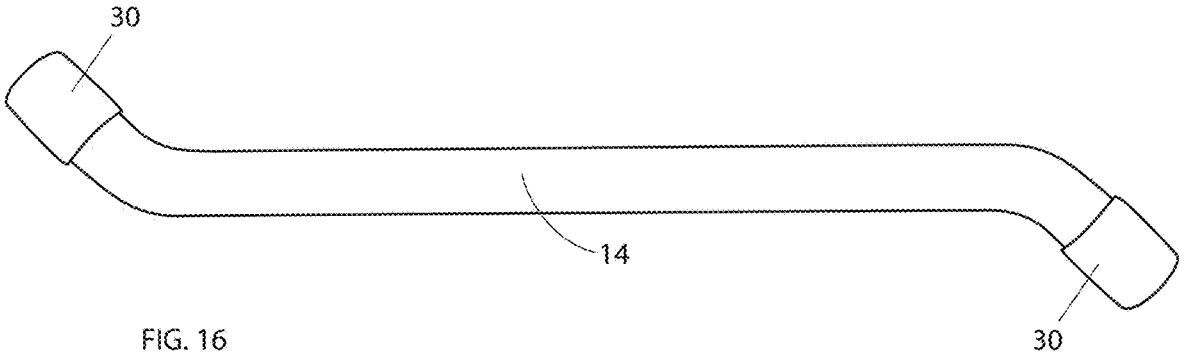
FIG. 16 is a perspective view of the transfer instrument with caps at both ends to protect transfer labels or adhesive dots.

As another embodiment, with reference to FIG. 16, the instrument 14 may have be configured to have both ends 14A capable of accepting glue dots 10 or transfer labels 16. For example, the instrument 14 may have an S-shape (FIG. 16) or C-shape capable of transferring target labels 20. It is contemplated to use the same adhesive dot 10 (FIG. 3) or transfer label 16 in multiple cycles of target label transfer, over separate time periods. Accordingly, as shown in FIG. 16, the end surfaces 14A of the instrument 14 may be protected with caps 30. The caps 30 may include a non-stick liner in their internal cavity, such as a silicone liner. It is contemplated to provide the instrument 14 with an adhesive dot 10 and/or transfer label(s) 16 pre-applied to the end surface(s) 14A, and in such an arrangement a cap(s) 30 may be useful in protecting the transfer label(s) 16 or more specifically protecting the adhesive surface of the transfer label 16.

The instrument 14 may have more than one tip on each end or on either end, it might have exchangeable tips for different shapes and/or dimensions, or it might have a rotational configuration allowing revolving of available tips. According to an embodiment, the instrument 14, with or without glue, can be sterile or can be sterilised such as via autoclaving, gamma irradiation, ethylene oxide or other method. The transfer label 16 can be in a sterile condition or can be sterilised such as via autoclaving, gamma irradiation, ethylene oxide or other method. In an embodiment, a kit is provided in a sterile condition, or that can be sterilised, the kit including the instrument 14, with or without a glue, one or more transfer labels 16 with or without target labels 20. The kit may include an object for the target label, all of which may be in a sterile condition or sterilisable.

The invention claimed is:

1. A kit for labelling an object with a target label comprising:

an instrument having at least one end for manipulating labels;

at least one transfer label including a facestock having a first surface configured to be adhered to the end of the instrument, the facestock of the transfer label having transfer label adhesive on a second surface thereof, at least one target label adhered to a target label liner by a target label adhesive having an adhesion force E, the target label having a facestock adapted to have information inscribed/printed thereon, an adhesive having an adhesion force A between the first surface of the facestock of the transfer label and the instrument, wherein the adhesion force A is greater than an adhesion force B of the transfer label adhesive between the transfer label and the facestock of the target label, wherein the adhesion force B between the transfer label and the facestock of the target label is greater than the adhesion force E, and wherein the target label adhesive provides an adhesion force F between the target label and a target surface of an object, the adhesion force F adapted to be greater than said adhesion force B, whereby the instrument and transfer label are used to manually transfer the target label from a target label liner to the target surface of the object by releasable adherence of the target label to the transfer label adhesive on the second surface of the transfer label at the end of the instrument.

2. The kit according to claim 1, further comprising at least one transfer label liner supporting the at least one transfer label, the adhesion force A between the first surface of the facestock of the transfer label and the end of the instrument being greater than an adhesion force C of the transfer label adhesive between the second surface of the transfer label and the transfer label liner, whereby the instrument is used to manually transfer the transfer label from the at least one transfer label liner to its end by releasable adherence of the transfer label to the end of the instrument.

3. The kit according to claim 1, wherein both the first surface and the second surface of the transfer label have adhesive thereon.

4. The kit according to claim 3, comprising a first transfer label liner and a second transfer label liner, the first transfer label liner being on the first surface of the transfer label, and the second transfer label liner being on the second surface of the transfer label, the first transfer label liner removed to expose the first surface of the transfer label, the adhesion force A between the first surface of the facestock of the transfer label and the end of the instrument being greater than an adhesion force C of the transfer label adhesive between the second surface of the transfer label and the second transfer label liner, whereby the instrument is used to manually transfer the transfer label from the second transfer label liner to its end by releasable adherence of the transfer label to the end of the instrument.

5. The kit according to claim 1, wherein the target label has a largest dimension between 0.05" and 0.5" inclusively.

6. The kit according to claim 1, wherein the target label has a largest dimension between 0.2" and 1" inclusively.

7. The kit according to claim 1, wherein the adhesive having the adhesion force A is instrument adhesive for being received on said end of the instrument to provide said adhesion force A.

8. The kit according to claim 7, wherein the instrument adhesive is defined by a dot of the instrument adhesive adhered to a dot liner, an adhesion force G between the dot and the instrument being greater than an adhesion force H between the dot and the dot liner.

9. The kit according to claim 1, wherein the target label comprises an RFID tag, NFC tag, any electronic component and/or a wireless component.

10. The kit according to claim 1, further comprising a cap for being releasably mounted to the end of the instrument to cover the transfer label on the end of the instrument, an adhesion force I between the second surface of the transfer label and the cap being less than the adhesion force A.

11. The kit according to claim 10, wherein the cap has a silicone layer laid against the second surface of the transfer label.

12. The kit according to claim 1, wherein the at least one transfer label has a tab projecting therefrom, the tab being sized to project from the end of the instrument when the transfer label is on the end of the instrument.

13. The kit according to claim 2, wherein the at least one transfer label liner has tear-off perforations and/or at least one slit therein.

14. The kit according to claim 1, wherein the instrument and/or the labels are in a sterilized condition in packaging.

15. The kit according to claim 1, wherein the instrument is a rod and/or is pen-shaped.

16. The kit according to claim 1, wherein the instrument has two of the ends for manipulating labels.

17. The kit according to claim 16, wherein the instrument has a S-shape.

18. The kit according to claim 1, wherein the instrument has a receptacle, and adhesive in the receptacle, the receptacle open to the end for adhesive in the receptacle to be exposed at the end.

19. The kit according to claim 1, wherein the instrument has an exchangeable tip at the end.

* * * * *